United States Patent [19]

Stahlecker

[11] Patent Number: 5,065,572

[45] Date of Patent: Nov. 19, 1991

[54] FIBER SUPPLY ARRANGEMENT FOR OPEN-END ROTOR SPINNING

[75] Inventor: Fritz Stahlecker, Bad Überkingen, Fed. Rep. of Germany

[73] Assignee: Hans Stahlecker, Fed. Rep. of Germany; a part interest

[21] Appl. No.: 520,754

[22] Filed: May 9, 1990

[30] Foreign Application Priority Data

May 18, 1989 [DE] Fed. Rep. of Germany ..... 3916238

[51] Int. Cl.[5] ..... D01H 4/38

[52] U.S. Cl. ..... 57/413; 57/408; 57/411

[58] Field of Search ..... 57/404, 406–408, 57/411–413, 415, 301, 302

[56] References Cited

U.S. PATENT DOCUMENTS

| | | | |
|---|---|---|---|
| 3,511,044 | 5/1970 | Stary | 57/411 |
| 3,521,440 | 7/1970 | Oskin et al. | 57/413 |
| 3,523,300 | 8/1970 | Tabata et al. | 57/415 X |
| 3,604,194 | 9/1971 | Edagawa | 57/415 X |
| 4,459,800 | 7/1984 | Stawlecker | 57/413 X |
| 4,976,099 | 12/1990 | Brockmanns et al. | 57/411 |

FOREIGN PATENT DOCUMENTS

| | | |
|---|---|---|
| 1914115 | 9/1970 | Fed. Rep. of Germany . |
| 3704460 | 8/1988 | Fed. Rep. of Germany . |
| 3730706 | 3/1989 | Fed. Rep. of Germany . |

*Primary Examiner*—Daniel P. Stodola
*Assistant Examiner*—William Stryjewski
*Attorney, Agent, or Firm*—Evenson, Wands, Edwards, Lenahan & McKeown

[57] ABSTRACT

In an arrangement for open-end rotor spinning having a fiber feeding duct starting at a feeding and opening device and tapering in the direction of the spinning rotor, it is provided that at least one bypass opening in the fiber feeding duct is provided at a point which has a larger cross-section than the mouth of the fiber feeding duct, and in that the fiber feeding duct has a deflection in front of the bypass opening by which the fibers are guided past the bypass opening.

17 Claims, 2 Drawing Sheets

FIBER SUPPLY ARRANGEMENT FOR OPEN-END ROTOR SPINNING

BACKGROUND AND SUMMARY OF THE INVENTION

The invention relates to an arrangement for open-end rotor spinning having a spinning rotor which has a fiber sliding surface expanding conically to form a fiber feeding groove. The mouth of a fiber feeding duct is disposed opposite the fiber sliding surface. The fiber feeding duct starts at an opening roller and tapers in the direction toward the fiber sliding surface. An insert projects into the spinning rotor which is a component of a cover closing a rotor housing which is connected to a vacuum source which takes in an air current through the fiber feeding duct. The fiber feeding duct is provided with at least one bypass opening at a distance from the mouth.

In order to ensure optimum spinning conditions, the fibers transported in the fiber feeding duct by means of the air current should arrive on the fiber sliding wall, on the one hand, at a sufficient distance from the open end of the spinning rotor and, on the other hand, at a sufficient distance from the fiber collecting groove.

By means of the distance to the open end of the spinning rotor, it is to be avoided that the air flowing off by way of the open rotor edge takes along fibers. The distance from the fiber collecting groove is to have the effect that the fibers are stretched and aligned on the fiber sliding surface between the point of arrival and the fiber collecting groove. In modern open-end rotor spinning, a trend exists leading toward progressively smaller spinning rotors so that the operating speeds are higher. In this case, it becomes more difficult to meet the above-mentioned requirements. It is therefore necessary to guide the fibers in a very targeted manner to a certain point of the fiber sliding surface of the spinning rotor. This may be implemented by means of a fiber feeding duct with a small mouth. However, the small mouth has the result that the amount of air of the taken-in air current is reduced so that disturbances may occur in the fiber transport and/or fly in the area of the opening roller.

In order to solve the described problem, it is known from German patent document DE-37 04 460 A1 to enlarge the mouth of the fiber feeding duct in the circumferential direction of the spinning rotor but to keep it as small as possible in the axial direction of the spinning rotor.

It has also become known from German patent document DE-37 30 706 A1 to open up the fiber feeding duct starting from its end located opposite the fiber sliding surface of the spinning rotor by means of a lateral slot so that the cross-section which is decisive for the taken-in amount of air is placed back into an area of the fiber feeding duct having a larger diameter.

It is also known from German patent document DE-31 20 877 A1, corresponding to U.S. Pat. No. 4,459,800, to separate the fibers even before the entry into the spinning rotor from the transport air flow and thus also from fine dirt particles, particularly from dust. For this purpose, the fiber feeding duct is interrupted in the area before it reaches the spinning rotor or is provided with openings having a relatively large cross-section.

It is also known from German patent document DE-19 14 115 A1 to provide a fiber feeding duct of an open-end rotor spinning arrangement with a deflection in the form of a bend. In this construction, dirt contained in the fibers is to be eliminated. For this reason, the fiber feeding duct, in the area of the bending point, is open as a linear extension. Another air intake opening is provided against the transport direction as a linear extension of the second section so that air is taken in here which deflects the fibers in the direction of the second part of the fiber feeding duct in the area of the bending point.

An object of the invention is to develop an arrangement of the initially mentioned type such that, when a mouth of the fiber feeding duct is provided which has a small cross-section, a sufficient current of transport air is taken in.

This object is achieved according to preferred embodiments of the invention in that the at least one bypass opening is provided at a point of the fiber feeding duct which has a larger cross-section than the mouth of the fiber feeding duct, in that the fiber feeding duct is provided with at least one deflection for the fiber transport direction and in that the bypass opening is disposed behind the deflection in the transport direction and in an area facing away from the deflection.

By means of the bypass opening, the intake cross-section may be enlarged so that, despite a small cross-section of the mouth, a sufficiently large amount of air can be taken in. In order not to be subjected to any significant limitations concerning the dimensioning of the bypass opening, it is provided by means of the deflection that the fibers are guided past the bypass opening at a relatively large distance so that the danger of a sucking-off of fibers is relatively small.

Other objects, advantages and novel features of the present invention will become apparent from the following detailed description of the invention when considered in conjunction with the accompanying drawings.

DETAILED DESCRIPTION OF THE DRAWINGS

Figure 1:
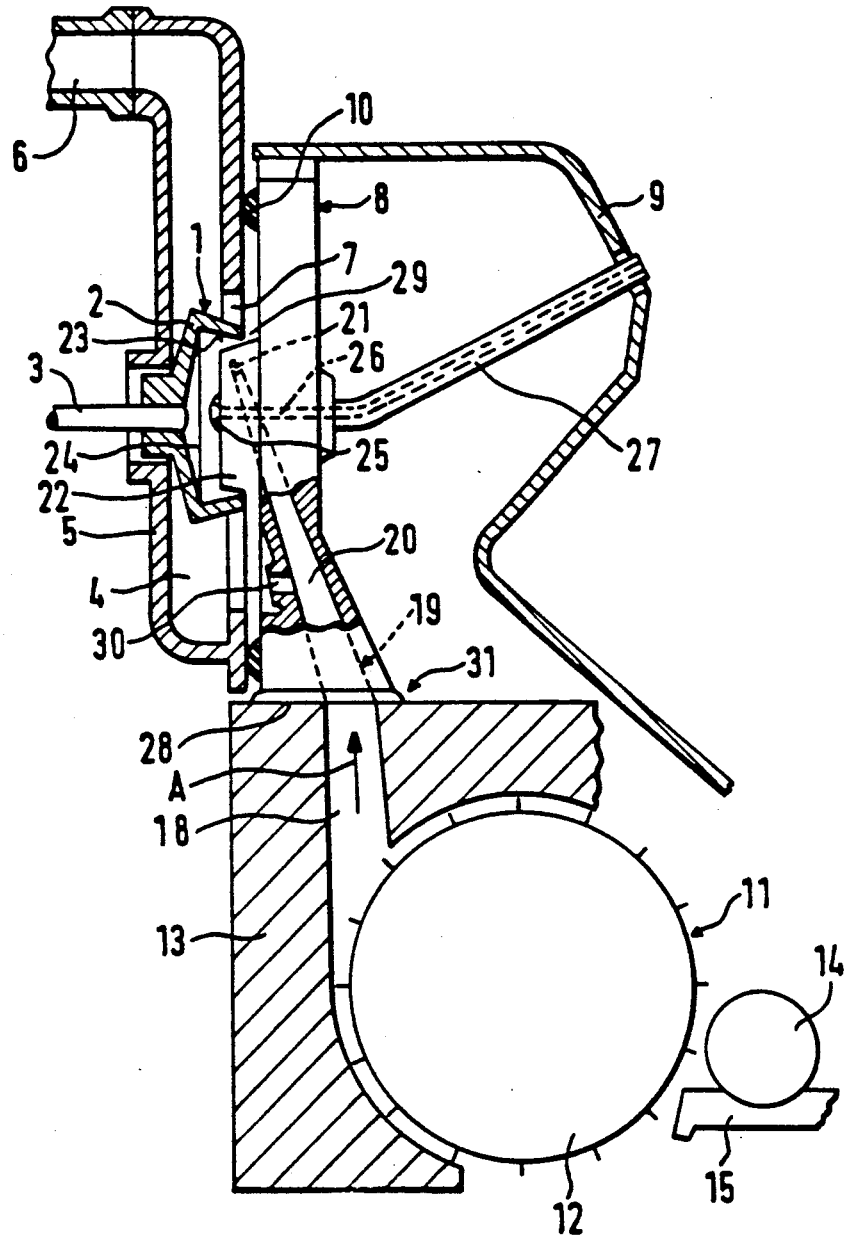
FIG. 1 is a schematic vertical sectional view of an open end rotor spinning unit, constructed according to a preferred embodiment of the invention having a bent fiber feeding duct.
Figure 2:
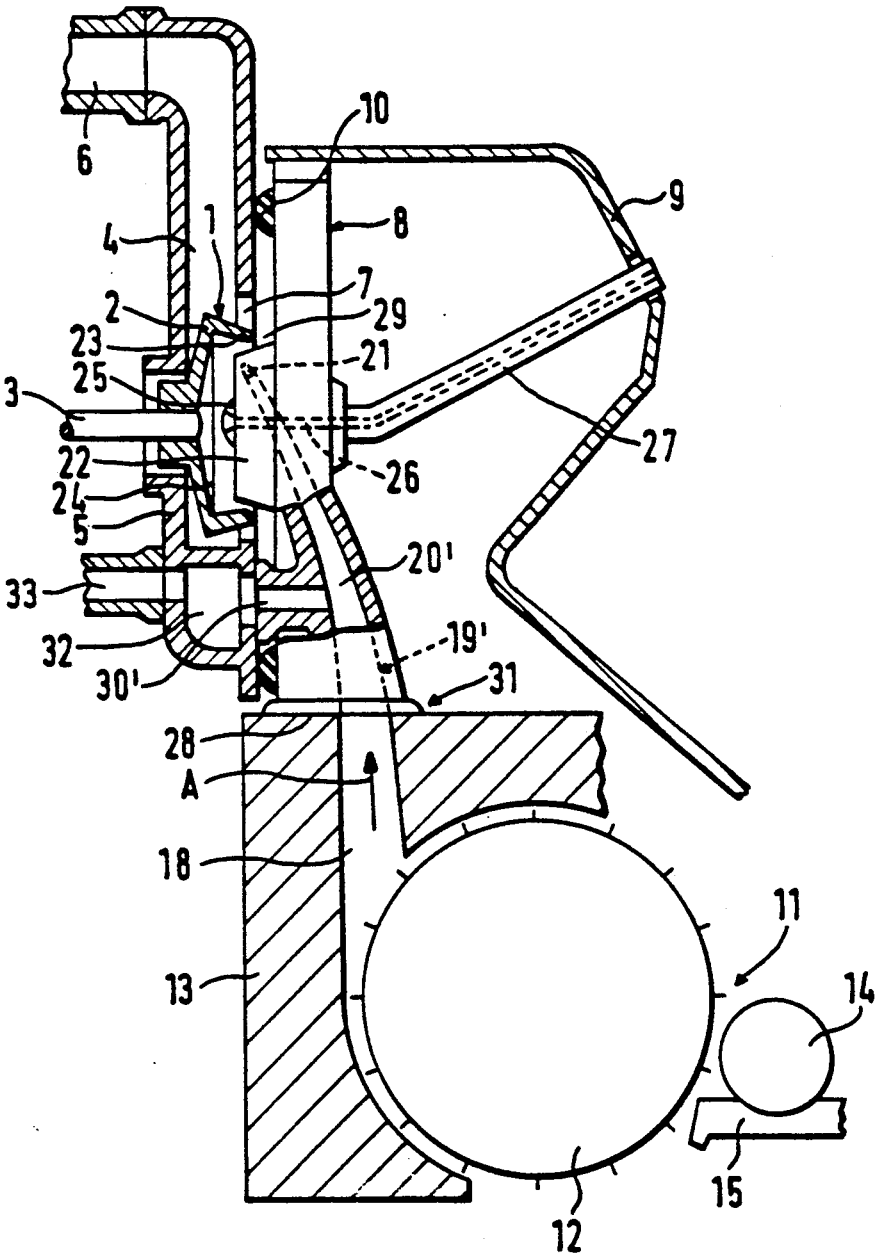
FIG. 2 is a schematic vertical sectional view of another embodiment of an arrangement according to the invention having an arcuately curved fiber feeding duct.

The arrangements shown in FIGS. 1 and 2 are constructed according to the same basic principle so that the same reference numbers are used for the same components. Different reference numbers are used only for changed components.

The open-end spinning arrangement shown in FIG. 1 is a component of an open-end spinning machine which is equipped with a plurality of spinning arrangements of this type which, in each case, are arranged in a row next to one another on both sides of the machine. The spinning arrangement comprises a spinning rotor 1 which has a rotor dish or disk 2 which is non-rotatably arranged on a rotor shaft 3. The rotor shaft 3 is disposed and drivable in a manner not shown in detail. The rotor disk 2 is arranged in a rotor housing 5 which forms a vacuum chamber 4 surrounding the rotor disk 2 and is connected to a suction line 6 connected with a vacuum source which is not shown.

On the side facing away from the rotor shaft 3, the rotor housing 5 is provided with an opening 7 which is closed by means of a cover 8. The cover 8 is held by a covering 9 which, in a manner not shown in detail, can be swivelled around an axis extending in the longitudinal direction of the machine in such a manner that, while the cover 8 is taken along, the opening 7 of the rotor housing 5 can be exposed. The cover 8 is provided with a surrounding seal 10 which sealingly places itself against the rotor housing 5.

The spinning arrangement also comprises a feeding and opening device 11. The feeding and opening device 11 is equipped with a drivable feeding roller 14 against which a feeding table 15 is pressed in an elastic manner. The feeding roller 14 and the feeding table 15 offer a sliver which is not shown to a faster rotating opening roller 12 which is provided on its circumference with a mounting consisting of teeth or needles. The opening roller 12 which is arranged in a housing 13 combs out the fed sliver and separates fibers from it which, in this manner, are fed individually and by way of a fiber feeding duct 19 starting at the opening roller 12 in the direction of the arrow (A) to the spinning rotor 1.

In the spinning rotor 1, the fibers reach a fiber sliding surface 23 which expands conically to form a fiber collecting groove 24 from which the fibers are withdrawn as a yarn. An insert 22 projects into the open side of the rotor disk 2 and has a shape which tapers slightly conically toward the rotor disk 2. The mouth 21 of the fiber feeding duct 19 is located in this insert 22. The insert 22 also comprises a yarn withdrawal nozzle 25 arranged coaxially with respect to the rotor shaft 3, by means of which the spun yarn is withdrawn. The withdrawn yarn, by way of a yarn withdrawal duct 26 and a yarn withdrawal tube 27, reaches a withdrawal device which is not shown.

In modern open-end rotor spinning machines, there is a tendency toward smaller spinning rotors 1 in order to be able to work with speeds that are as high as possible and therefore with increased productivity. The diameters of such rotor disks 2 in the are of the fiber collecting groove 24 today measure 30 mm or less. In order to obtain perfect spinning conditions despite this small rotor disk 2 and the therefore necessarily shortened fiber sliding surface 23, it is endeavored to guide the fibers to the fiber sliding surface 23 as punctiform as possible at a predetermined point. This can be achieved in that the mouth 21 of the fiber feeding duct 19 correspondingly is provided a small outlet cross-section. In order to ensure a perfect emerging of the fibers, this cross-section should, however, not be any less than 4.5 mm. The fiber feeding duct 19 must start with a cross-section which is adapted to the working width of the opening roller 12 and which therefore is relatively large in comparison to the mouth 21. The risk therefore exists that no sufficient amount of air flows in the fiber feeding duct 19 tapering from the opening roller 12 to the rotor disk 2, this amount of air being a function of the vacuum in the rotor disk 2 and the cross-section of the mouth 21 of the fiber feeding duct 19.

The fiber feeding duct 19 has two sections 18, 20. The first section 18 is located in the housing 13 of the opening roller 12. The second section 20 is a component of the cover 8. It connects to the housing 13 by means of a sliding surface 28. In order to be able to take in a sufficient amount of air in the fiber feeding duct 19 despite the small mouth 21, section 20, at a point which has a larger cross-section than the mouth 21, is provided with a bypass opening 30 which is located opposite the opening 7 of the rotor housing and is thus connected with the vacuum chamber 4. The two linear sections 18, 20 of the fiber feeding duct 19 are arranged at an angle so that a deflection point 31 is formed in the area of the sliding surface 28. In this case, section 20 is more sloped in the direction of the rotor disk 2. Therefore, the fibers transported in the fiber feeding duct 19 also experience a deflection by means of which they are deflected in the direction to the wall of the section 20 of the fiber feeding duct 19 which faces away from the rotor disk 2. The bypass opening 30 is located behind the deflection 31 on the side of section 20 of the fiber feeding duct 19 which faces away from the deflection; i.e., on the interior path of the deflection 31. This ensures that the fibers, because of their larger mass, are not sucked off by way of the bypass opening 30 but are securely transported past this bypass opening 30.

The embodiment according to FIG. 2 differs from the embodiment according to FIG. 1 first in the area of section 20' of the fiber feeding duct 19'. Section 20' is constructed to be arcuately curved in such a manner that it starts approximately as an extension of the linear section 18 and then slopes arcuately in the direction of the rotor disk 2. Thus, a deflection 31 is provided also in the area of the sliding surface 28 by means of which the fibers transported in the transport air current are deflected in the direction of the wall of section 20' of the fiber feeding duct 19' facing away from the rotor disk 2.

In the conveying direction behind the deflection 31, a bypass opening 30' is provided through which air is sucked off, in addition to the suction at the mouth 21. As a result, a sufficient amount of air is taken into the fiber feeding duct 19'.

The bypass opening 30' of the embodiment according to FIG. 2 is connected to a vacuum source which is not shown by way of a separate suction pipe 33. The bypass opening 30' leads into a partitioned-off chamber 32 of the rotor housing 5 which is connected with the suction pipe 33. As a result, it is possible to, in addition, proportion the vacuum applied at the bypass opening 30' in such a manner that, despite the increase of the amount of air, no fibers are sucked off by way of the bypass opening 30'. In this case, it is provided that the vacuum pressure existing in section 20' of the duct segment starting directly behind the bypass opening 30' corresponds approximately to the vacuum existing in the bypass opening 30'.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. An arrangement for open-end rotor spinning comprising:

a spinning rotor which has a fiber sliding surface expanding conically toward a fiber collecting groove, a fiber feeding duct having a mouth disposed opposite the fiber sliding surface, the fiber feeding duct starting at a fiber opening means and tapering in the direction toward the fiber sliding surface to define a fiber transport direction path for fibers being fed therethrough, said fiber feeding duct including at least one deflection for deflecting the fiber transport direction therethrough, vacuum source means communicating with the fiber feeding duct mouth for creating an air flow to carry fibers in the fiber feeding duct from the opening means to the mouth, and a bypass opening to the fiber feeding duct located outside of the rotor area and connected to further vacuum source means for withdrawing air from the fiber feeding duct and thereby increasing air flow aided fiber transport during spinning operations, said bypass opening being in bypassing relation to the mouth of the fiber feeding duct, wherein the bypass opening is disposed downstream of the deflection in the fiber transport direction and at a side of the fiber feeding duct opposite the side of the fiber feeding duct where the fibers travel due to the deflection, whereby the fiber transport in the feeding duct during spinning operations is enhanced by the bypass opening while minimizing fiber loss through the bypass opening.

2. An arrangement according to claim 1, wherein the fiber feeding duct exhibits an interior and an exterior path for the fibers and air travelling in the region of the deflection, wherein the bypass opening is situated on an interior path of the deflection.

3. An arrangement according to claim 2, wherein the fiber feeding duct has a bent course.

4. An arrangement according to claim 2, wherein a rotor housing is provided which surrounds the rotor, and wherein the bypass opening is connected to the rotor for the rotor such that the vacuum in the rotor housing serves as both the vacuum source and the further vacuum source.

5. An arrangement according to claim 2, wherein the rotor is housed in a rotor housing which is connected to the vacuum source means, and wherein said bypass opening is connected to a separate vacuum supply from the vacuum in the rotor housing, said separate vacuum supply serving as said further vacuum source means.

6. An arrangement according to claim 2, wherein the bypass opening has a smaller cross-section than the mouth of the fiber feeding duct.

7. An arrangement according to claim 1, wherein the fiber feeding duct has a bent course.

8. An arrangement according to claim 7, wherein the fiber feeding duct is composed of two sections which extend at an oblique angle to one another.

9. An arrangement according to claim 4, wherein the fiber feeding duct exhibits an interior and an exterior path for the fibers and air travelling in the region of the deflection, wherein the bypass opening is situated on an interior path of the deflection.

10. An arrangement according to claim 8, wherein the bypass opening has a smaller cross-section than the mouth of the fiber feeding duct.

11. An arrangement according to claim 1, wherein the fiber feeding duct has an arcuately curved section.

12. An arrangement according to claim 11, wherein the bypass opening is situated on an interior path of the deflection.

13. An arrangement according to claim 1, wherein a rotor housing is provided which surrounds the rotor, and wherein the bypass opening is connected to the rotor housing for the rotor such that the vacuums in the rotor housing serves as both the vacuum source and the further vacuum source.

14. An arrangement according to claim 13, wherein the bypass opening has a smaller cross-section than the mouth of the fiber feeding duct.

15. An arrangement according to claim 1, wherein the rotor is housed in a rotor housing which is connected to the vacuum source means, and wherein said bypass opening is connected to a separate vacuum supply from the vacuum in the rotor housing, said separate vacuum supply serving as said further vacuum source means.

16. An arrangement according to claim 15, wherein the bypass opening has a smaller cross-section than the mouth of the fiber feeding duct.

17. An arrangement according to claim 1, wherein the bypass opening has a smaller cross-section than the mouth of the fiber feeding duct.

* * * * *